US010227542B2

(12) United States Patent
Oh

(10) Patent No.: US 10,227,542 B2
(45) **Date of Patent: *Mar. 12, 2019**

(54) OIL COMPOSITIONS WITH IMPROVED FUEL ECONOMY AND DURABILITY

(71) Applicant: Hyundai Motor Company, Seoul (KR)

(72) Inventor: Jung Joon Oh, Gyeonggi-do (KR)

(73) Assignee: Hyundai Motor Company, Seoul (KR)

( * ) Notice: Subject to any disclaimer, the term of this patent is extended or adjusted under 35 U.S.C. 154(b) by 10 days.

This patent is subject to a terminal disclaimer.

(21) Appl. No.: 15/234,555

(22) Filed: Aug. 11, 2016

(65) Prior Publication Data

US 2017/0145339 A1 May 25, 2017

(30) Foreign Application Priority Data

Nov. 19, 2015 (KR) ..... 10-2015-0162870

(51) Int. Cl.
*C10M 141/10* (2006.01)

(52) U.S. Cl.
CPC ..... *C10M 141/10* (2013.01); *C10M 2205/06* (2013.01); *C10M 2207/141* (2013.01); *C10M 2207/283* (2013.01); *C10M 2215/062* (2013.01); *C10M 2219/068* (2013.01); *C10M 2223/045* (2013.01); *C10N 2230/02* (2013.01); *C10N 2230/041* (2013.01); *C10N 2230/06* (2013.01); *C10N 2230/10* (2013.01); *C10N 2240/102* (2013.01)

(58) Field of Classification Search
CPC combination set(s) only.
See application file for complete search history.

(56) References Cited

U.S. PATENT DOCUMENTS

| | | | | |
|---|---|---|---|---|
| 5,863,873 | A | 1/1999 | Bovington | |
| 7,067,049 | B1 * | 6/2006 | Baillargeon | C10M 169/048 208/18 |
| 2005/0113265 | A1 * | 5/2005 | Yagishita | C10M 141/10 508/188 |
| 2005/0137098 | A1 | 6/2005 | Le Coent et al. | |
| 2006/0276351 | A1 * | 12/2006 | Mucha | C10M 169/04 508/199 |
| 2015/0087567 | A1 | 3/2015 | Ushioda | |
| 2015/0111798 | A1 | 4/2015 | Li et al. | |

FOREIGN PATENT DOCUMENTS

| | | | |
|---|---|---|---|
| EP | 2128231 | A2 | 12/2009 |
| KR | 10-1998-0040739 | A | 8/1998 |
| KR | 1999-014470 | A | 2/1999 |
| KR | 10-0506718 | B1 | 8/2005 |
| KR | 10-0559832 | B1 | 3/2006 |
| KR | 2010-0049350 | A | 5/2010 |
| KR | 2011-0031836 | A | 3/2011 |
| KR | 2011-0051852 | A | 5/2011 |
| KR | 2015-0094521 | A | 8/2015 |

* cited by examiner

*Primary Examiner* — Ellen M McAvoy
*Assistant Examiner* — Chantel L Graham
(74) *Attorney, Agent, or Firm* — Mintz Levin Cohn Ferris Glovsky and Popeo, P.C.; Peter F. Corless

(57) ABSTRACT

Disclosed is an oil composition with improved fuel economy and durability. The oil composition may be effective in improving fuel economy by reduction of friction on sliding parts of vehicle engines and in preventing abrasion of the engines by effective dispersion of soot in respective parts of the engines. The oil composition comprises a detergent dispersant, a friction reducer and a viscosity controller, which are suitably optimized at a mix ratio of those components.

10 Claims, 2 Drawing Sheets

| Test Mode | Time | Maximum Speed | Mean Speed | Driving Distance |
|---|---|---|---|---|
| ECE15 cycle | 780 sec | 50 km | 18.4 km/h | 3.98 km |
| EUDC cycle | 400 sec | 120 km | 62.6 km/h | 6.95 km |

OIL COMPOSITIONS WITH IMPROVED FUEL ECONOMY AND DURABILITY

CROSS-REFERENCE TO RELATED APPLICATION

This application claims under 35 U.S.C. § 119(a) the benefit of priority to Korean Patent Application No. 10-2015-0162870 filed on Nov. 19, 2015, the entire contents of which are incorporated herein by reference.

BACKGROUND

(a) Technical Field

The present invention relates to an oil composition with improved fuel economy and durability, particularly for the diesel engine. The oil composition may be effective in improving fuel economy by reduction of friction on sliding parts of vehicle engines and in preventing abrasion of the engines by effective dispersion of soot in respective parts of the engines. The oil composition may comprise a detergent dispersant, a friction reducer and a viscosity controller which may be optimized with a mix ratio of the components.

(b) Background Art

Recently, regulations on vehicle exhaust gases such as carbon dioxide have become stricter to efficiently use energy and prevent global warming, and fuel-efficient engine oils have been actively developed to reduce energy loss of engines in response to such environmental regulations. In order to satisfy such environmental regulations, a great deal of research has continuously made to improve fuel economy by changes of engine structures of vehicles or development of low-friction low-viscosity engine oils.

In general, improvement in fuel economy using engine oils may be achieved by reducing both fluid resistance of the engine oils and friction of sliding parts. Although fluid resistance may be somewhat reduced by reducing viscosity of engine oils, diesel engines may generate soot due to incomplete combustion of fuel oils as driving distance increases and the soot increases viscosity of the engine oils and facilitates a friction increase and abrasion of engines. Accordingly, fuel-efficient diesel engine oils may require technologies for reducing oil viscosity and solving the problems of in the increased viscosity of engine oils and abrasion/friction caused by soot generated during vehicle driving.

The above information disclosed in this Background section is only for enhancement of understanding of the background of the invention and therefore it may contain information that does not form the prior art that is already known in this country to a person of ordinary skill in the art.

SUMMARY

In preferred aspects, the present invention provides an oil composition.

Accordingly, as a result of repeated research to solve the problems of conventional vehicle diesel engine oils, the present inventors found that soot dispersibility and abrasion resistance can be improved, variation in viscosity of diesel engine oils can be minimized and low friction coefficient can be continuously maintained as wear continues by optimizing components of the oil composition such as a detergent dispersant, a friction reducer and a viscosity controller, and content ratios thereof. The present invention was completed based on this finding. The oil composition may be used in an engine of a vehicle without limitations, and the oil composition may be suitably a diesel engine for the vehicle.

In one aspect of the present invention, provides is an oil composition with improved fuel economy and durability.

The oil composition may comprise: an amount of about 70 to 90% by weight of a base oil having a kinematic viscosity at a temperature of 100° C. of about 3 to 10 cSt, an amount of about 1 to 10% by weight of calcium salicylate, an amount of about 1 to 5% by weight of a $C_{10-40}$ alkyl hydroxy benzoate metal salt and glycerol monooleate, and an amount of about 5 to 15% by weight of a hydrogenated styrene-diene copolymer. Unless otherwise indicated, all these % by weights are based on the total weight of the oil composition.

In at least certain aspects, the oil composition suitably may include calcium salicylate as a detergent dispersant herein.

In at least certain aspects, the oil composition suitably may include the $C_{10-40}$ alkyl hydroxy benzoate metal salt and glycerol monooleate as a friction reducer herein.

In at least certain aspects, the oil composition suitably may include the hydrogenated styrene-diene copolymer as a viscosity controller.

In at least certain aspects, the $C_{10-40}$ alkyl hydroxy benzoate metal salt and the glycerol monooleate suitably may be present in a weight ratio of about 1:6 to 6:1.

In at least certain aspects, the $C_{10-40}$ alkyl hydroxy benzoate metal salt and the glycerol monooleate suitably may be present in a weight ratio of about 1:3 to 3:1.

In at least certain aspects, the oil composition may further include an amount of about 1 to 5% by weight of zinc dialkyldithiophosphate and an amount of about 0.1 to 2% by weight of molybdenum dithiocarbamate. The oil composition suitably may include zinc dialkyldithiophosphate and molybdenum dithiocarbamate as an abrasion-resistant agent.

The present invention provides the oil composition that may consist essentially of, essentially consist of, or consist of the components as described herein. For instance, the oil composition may consist essentially of, essentially consist of, or consist of: an amount of about 70 to 90% by weight of a base oil having a kinematic viscosity at a temperature of 100° C. of about 3 to 10 cSt, an amount of about 1 to 10% by weight of calcium salicylate, an amount of about 1 to 5% by weight of a $C_{10-40}$ alkyl hydroxy benzoate metal salt and glycerol monooleate, and an amount of about 5 to 15% by weight of a hydrogenated styrene-diene copolymer.

Further, the oil composition may consist essentially of, essentially consist of, or consist of: an amount of about 70 to 90% by weight of a base oil having a kinematic viscosity at a temperature of 100° C. of about 3 to 10 cSt, an amount of about 1 to 10% by weight of calcium salicylate, an amount of about 1 to 5% by weight of a $C_{10-40}$ alkyl hydroxy benzoate metal salt and glycerol monooleate, an amount of about 5 to 15% by weight of a hydrogenated styrene-diene copolymer, and an amount of about 1 to 5% by weight of zinc dialkyldithiophosphate, and an amount of about 0.1 to 2% by weight of molybdenum dithiocarbamate, all these % by weights are based on the total weight of the oil composition.

In another aspect, the present invention provides a method of preparing an oil composition as described herein. The method may comprise: providing the base oil; adding the remaining components to form a mixture; and stirring the mixture using a stirrer at temperatures of about 70° C. or greater.

Preferably, the remaining components may be sequentially added in order of increasing activity from lowest to highest.

The term "activity" as used herein refers to a chemical property of the components, particularly in terms of reactivity to other components in the engine oil composition. Accordingly, the remaining component having the least reactivity may be added first, and the components of increasing reactivity may be added later. Preferably, the method may comprise, after providing the base oil, adding sequentially the detergent dispersant, the abrasion-resistant agent, the friction reducer, and the viscosity controller to the base oil in this order.

For example, after providing the base oil, an amount of about 1 to 10% by weight of calcium salicylate; an amount of about 1 to 5% by weight of zinc dialkyldithiophosphate and an amount of about 0.1 to 2% by weight of molybdenum dithiocarbamate; an amount of about 1 to 5% by weight of a $C_{10-40}$ alkyl hydroxy benzoate metal salt and glycerol monooleate; and an amount of about 5 to 15% by weight of a hydrogenated styrene-diene copolymer may be sequentially added in this order.

Alternatively, the remaining components suitably may be sequentially added in order of increasing added amount from largest amount to smallest amount.

Further provided is a vehicle that may comprise the oil composition as described herein.

Other aspects of the invention are discussed infra.

BRIEF DESCRIPTION OF THE DRAWINGS

The above and other features of the present invention will now be described in detail with reference to various exemplary embodiments thereof illustrated the accompanying drawings which are given hereinbelow by way of illustration only, and thus are not limitative of the present invention, and wherein.

Figure 1:
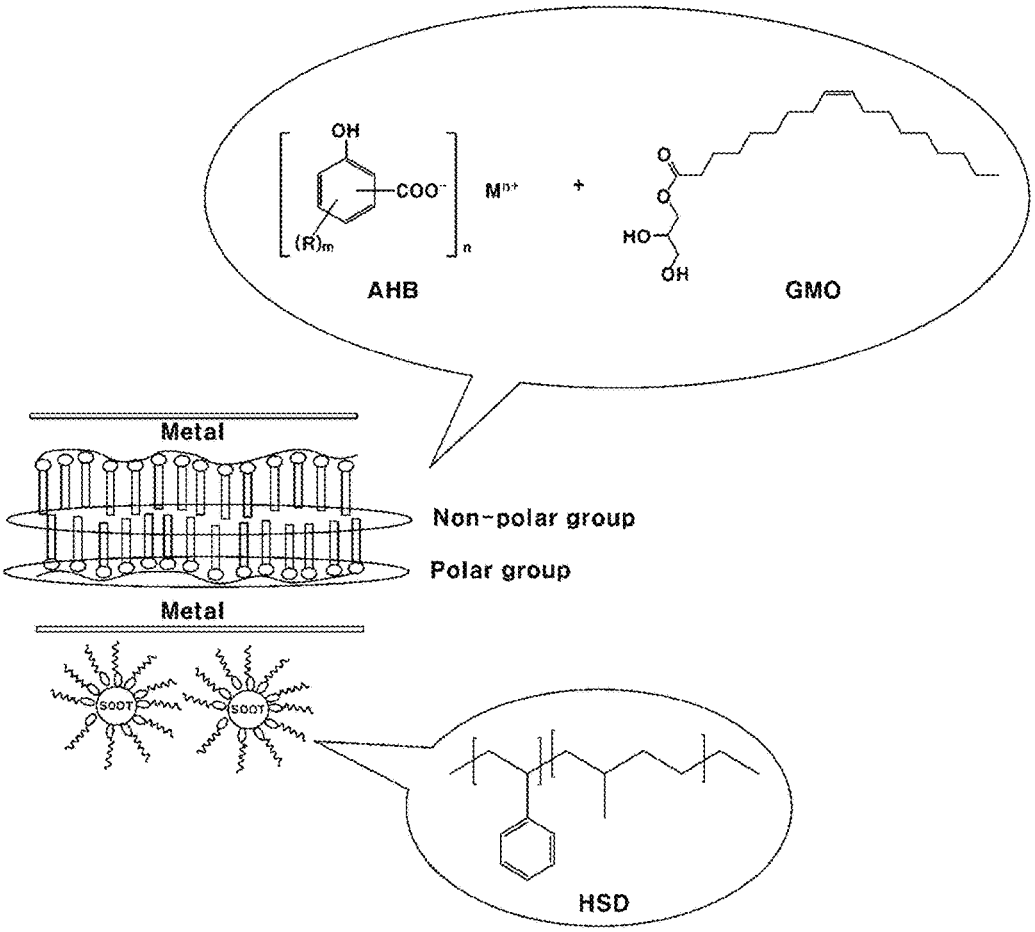
FIG. 1 illustrates an exemplary mechanism of mutual cooperation between a viscosity controller (HSD) and a friction reducer (AHB, GMO) that may increase dispersion of soot and control a viscosity decrease and abrasion/friction of engine oils.

It should be understood that the appended drawings are not necessarily to scale, presenting a somewhat simplified representation of various preferred features illustrative of the basic principles of the invention. The specific design features of the present invention as disclosed herein, including, for example, specific dimensions, orientations, locations, and shapes will be determined in part by the particular intended application and use environment.

In the figures, reference numbers refer to the same or equivalent parts of the present invention throughout the several figures of the drawing.

DETAILED DESCRIPTION

The terminology used herein is for the purpose of describing particular exemplary embodiments only and is not intended to be limiting of the invention. As used herein, the singular forms "a", "an" and "the" are intended to include the plural forms as well, unless the context clearly indicates otherwise. It will be further understood that the terms "comprises" and/or "comprising," when used in this specification, specify the presence of stated features, integers, steps, operations, elements, and/or components, but do not preclude the presence or addition of one or more other features, integers, steps, operations, elements, components, and/or groups thereof. As used herein, the term "and/or" includes any and all combinations of one or more of the associated listed items.

Unless specifically stated or obvious from context, as used herein, the term "about" is understood as within a range of normal tolerance in the art, for example within 2 standard deviations of the mean. "About" can be understood as within 10%, 9%, 8%, 7%, 6%, 5%, 4%, 3%, 2%, 1%, 0.5%, 0.1%, 0.05%, or 0.01% of the stated value. Unless otherwise clear from the context, all numerical values provided herein are modified by the term "about."

It is understood that the term "vehicle" or "vehicular" or other similar term as used herein is inclusive of motor vehicles in general such as passenger automobiles including sports utility vehicles (SUV), buses, trucks, various commercial vehicles, watercraft including a variety of boats and ships, aircraft, and the like, and includes hybrid vehicles, electric vehicles, plug-in hybrid electric vehicles, hydrogen-powered vehicles and other alternative fuel vehicles (e.g. fuels derived from resources other than petroleum). As referred to herein, a hybrid vehicle is a vehicle that has two or more sources of power, for example both gasoline-powered and electric-powered vehicles.

Hereinafter reference will now be made in detail to various embodiments of the present invention, examples of which are illustrated in the accompanying drawings and described below. While the invention will be described in conjunction with exemplary embodiments, it will be understood that present description is not intended to limit the invention to those exemplary embodiments. On the contrary, the invention is intended to cover not only the exemplary embodiments, but also various alternatives, modifications, equivalents and other embodiments, which may be included within the spirit and scope of the invention as defined by the appended claims.

The present invention relates to an oil composition with improved fuel economy and durability, and the oil composition may be suitably used for a diesel engine of a vehicle. The oil composition may comprise, as essential ingredients, a base oil, a detergent dispersant, a friction reducer and a viscosity controller and those components may be suitably mixed. In addition, the oil composition may further comprise one or more additives selected from an abrasion-resistant agent, an antioxidant and the like.

The oil composition according to the present invention may comprise: an amount of about 70 to 90% by weight of a base oil having a kinematic viscosity at a temperature of 100° C. of about 3 to 10 cSt, an amount of about 1 to 10% by weight of calcium salicylate, an amount of about 1 to 5% by weight of $C_{10-40}$ alkyl hydroxy benzoate metal salt and glycerol monooleate, and an amount of about 5 to 15% by weight of a hydrogenated styrene-diene copolymer. The calcium salicylate may serve as a detergent dispersant, the $C_{10-40}$ alkyl hydroxy benzoate metal salt and glycerol monooleate may serve as a friction reducer and the hydrogenated styrene-diene copolymer may serve as a viscosity controller as used herein.

In addition, the oil composition according to the present invention may further include, as an abrasion-resistant agent, an amount of about 1 to 5% by weight of zinc dialkyldithiophosphate and 0.1 to 2% by weight of molybdenum dithiocarbamate.

The respective ingredients of the oil composition according to the present invention will be described in more detail as follows.

(1) Base Oil

The base oil as used in the present invention refers to lubricants that may be used for lubrication of a mechanical system, for example, gearing systems. The base oil may function to prevent rapid contact between teeth, and melting and adhesion by reducing friction and abrasion. Preferably, the base oil may have a kinematic viscosity at a temperature of 100° C. of about 3 to 10 centistoke (cSt) and a viscosity index of about 100 or greater, or particularly of about 100 to 140. When the kinematic viscosity at the temperature of 100° C. of the base oil is less than about 3 cSt, the amount of evaporated oil may increase substantially under available conditions of high temperatures and an amount of used oil may thus be increased. When the kinematic viscosity at the temperature of 100° C. of the base oil is greater than about 10 cSt, fuel economy may be reduced due to excessively increased viscosity. The base oil may include one or more selected from the group consisting of highly refined mineral oils and synthetic oils.

The base oil may be present in an amount of about 70 to 90% by weight in the diesel engine oil composition of the present invention. When the content of the base oil is less than about 70% by weight, viscosity may be substantially increased due to relatively a high additive content. In addition, when the content of the base oil is greater than about 90% by weight, the engine oil may not function desirably due to relatively a low additive content.

(2) Detergent Dispersant

The oil composition of the present invention may include a calcium- or magnesium-dispersant as a detergent dispersant. Preferably, the detergent dispersant may be calcium-based dispersant, particularly a calcium salicylate. The detergent dispersant may be selected from those having a total base number of 400 or more, preferably 400 to 600. When the total base number of the metal salt used as the detergent dispersant is less than about 400, oxidation stability of the oil may be reduced. Accordingly, a detergent dispersant having a total base number of 400 or greater may be suitably used.

The detergent dispersant may be present in an amount of about 1 to 10% by weight in the diesel engine oil composition of the present invention. When the content of the detergent dispersant is less than about 1% by weight, a large amount of soot may be generated, and when the content of the detergent dispersant is greater than about 10% by weight, abrasion resistance may be substantially reduced.

(3) Friction Reducer

The oil composition of the present invention may include a friction reducer, and preferably, the friction reducer may be a mixture of $C_{10-40}$ alkyl hydroxy benzoate metal salt (AHB) and glycerol monooleate (GMO). The AHB and GMO used as the friction reducer in the present invention may have both a polar moiety of hydroxy and a non-polar moiety of alkyl chains. The polar moiety may be adsorbed on the surface of metal components such as engines to form a dense interface and the non-polar moiety may reduce fluid resistance to allow fluids such as engine oils to smoothly flow. As a result, the friction reducer may thoroughly disperse soot introduced into the engine oils, thereby reducing friction and abrasion and achieving fuel economy.

In the related arts, for example, Korean Patent Publication Laid-open No. 10-2010-0049350 has reported that the hydroxyl polar moiety of GMO may be adsorbed on the metal surface and oleate non-polar moiety thereof performs a lubricant action. However, when GMO is used alone for the oil composition of the diesel engine, the friction coefficient of diesel engines may not be sufficiently reduced. According to the present invention, when AHB is incorporated in the friction reducer in conjunction with GMO, formation of the lubricant film on the metal surface may be further activated, friction of fluids may be reduced and the role of preventing friction may be thus maximized.

The friction reducer consisting of a mixture of AHB and GMO may be present in an amount of about 1 to 5% by weight in the diesel engine oil composition of the present invention. When the content of the friction reducer is less than about 1% by weight, the effects of reducing friction and improving fuel economy may not be obtained, and when the content thereof is greater than about 5% by weight, mutual attraction between polar AHB and GMO may obstruct fluid flow.

Additionally, a mix ratio of AHB and GMO used as the friction reducer may be controlled or adjusted. The mix ratio of AHB and GMO may be maintained in a weight ratio of about 1:6 to 6:1. When the mix ratio is maintained, worn metals (e.g. Fe, Cu) may be detected in substantially reduced amount and good results upon piston durability test may thus be obtained. On the other hand, when the mix ratio is out of the mixing ratio as defined above, density of materials adsorbed on the metal surface may be decreased, or friction may be increased due to strong interaction between non-polar moieties. Preferably, AHB and GMO may be used in a weight ratio of about 1:3 to 3:1.

(4) Viscosity Controller

The oil composition of the present invention may include a viscosity controller, and preferably, the viscosity controller may be a hydrogenated styrene diene copolymer (HSD). The HSD may surround the surface of soot so as to prevent the size of soot from increasing. Accordingly, the HSD may prevent an increase in viscosity or abrasion by soot generated from the diesel engine. As a result, the HSD viscosity controller may reduce viscosity in high-temperature at a temperature (e.g. 80° C.) and high-shear condition at which fuel economy is measured, while maintaining high-temperature viscosity, thereby maintaining abrasion resistance and improving fuel economy. The addition effect of the HSD viscosity controller may be maximized by using the mixture of $C_{10-40}$ alkyl hydroxy benzoate metal salt (AHB) and glycerol monooleate (GMO) as the friction reducer.

The HSD viscosity controller may be present in an amount of about 5 to 15% by weight, or particularly of about 8 to 12% by weight, in the oil composition of the present invention. When the content of the HSD viscosity controller is less than about 5% by weight, the entire surface of soot and control of dispersion of soot may not be surrounded by the HSD. When the content of the HSD viscosity controller is greater than about 15% by weight, the force to surround the soot surface may be decreased due to interaction between particles of the HSD viscosity controller.

FIG. 1 illustrates an exemplary mechanism of mutual cooperation between the viscosity controller and the friction reducer. As discussed above, the interaction between the viscosity controller and the friction reducer may increase dispersion of soot and accordingly control viscosity and abrasion/friction. The $C_{10-40}$ alkyl hydroxy benzoate metal salt (AHB) and glycerol monooleate (GMO) used as the friction reducer may be surfactants having both a polar group and a non-polar group in one molecule. These friction reducer ingredients may be densely combined and adsorbed on the metal surface, thereby preventing adhesion of soot onto the metal. In addition, the hydrogenated styrene-diene copolymer (HSD) used as the viscosity controller may surround the surface of soot so as to allow the soot to not be adsorbed on the metal surface and uniformly dispersed. As a result, with mutual cooperation or interaction between the viscosity controller (HSD) and the friction reducer (AHB, GMO), soot may be uniformly dispersed in engine oils without adhering to the engine surface, and to control the growth of soot particles and accordingly inhibit an increase in viscosity of the engine oils.

(5) Additive

The oil composition according to the present invention may further include an abrasion-resistant agent, an antioxidant, a defoaming agent or the like, each of which may be generally used in the related art.

For instance, the oil composition of the present invention may further include zinc dialkyldithiophosphate (ZnDTP) and molybdenum dithiocarbamate (MoDTC) as an abrasion-resistant agent.

The zinc dialkyldithiophosphate (ZnDTP) may be classified into pri-ZnDTP or sec-ZnDTP according to the number of substituted alkyl groups. The pri-ZnDTP refers to ZnDTP having one substituted $C_{8-30}$ alkyl group on an end thereof and sec-ZnDTP refers to ZnDTP having two substituted $C_{8-30}$ alkyl groups on an end thereof. Pri-ZnDTP, sec-ZnDTP or a mixture thereof may be used in the present invention. The zinc dialkyldithiophosphate (ZnDTP) may be present in an amount of about 1 to 5% by weight in the oil composition of the present invention. When the content of ZnDTP is less than about 1% by weight, abrasion resistance may be sufficiently improved. When the content thereof is greater than about 5% by weight, soot may be generated and deterioration in abrasion resistance may occur.

The molybdenum dithiocarbamate (MoDTC) may be present to impart high-temperature stability to zinc dialkyldithiophosphate (ZnDTP) used in conjunction therewith as the abrasion-resistant agent. ZnDTP may be readily decomposed during high-temperature combustion, generating a large amount of soot. In the present invention, molybdenum dithiocarbamate (MoDTC) used in combination with ZnDTP may impart high-temperature stability to ZnDTP. The molybdenum dithiocarbamate (MoDTC) may be present in an amount of about 0.1 to 2% by weight in the oil composition of the present invention. When the content of MoDTC is less than about 0.1% by weight, friction may not be reduced, and when the content thereof is greater than about 2% by weight, sludge may be generated at high temperatures.

In addition, the oil composition according to the present invention may include an antioxidant so as to prevent oxidation of engine oils. Preferably, the antioxidant may be an amine-based antioxidant such as 3-hydroxydiphenylamine or phenyl-alpha-naphthylamine. The antioxidant may be included in an amount of about 0.1 to 3% by weight in the oil composition of the present invention. When the content of the antioxidant is less than about 0.1% by weight, oxidation prevention performance may be reduced and when the content thereof is greater than about 3% by weight, side effects such as competitive adsorption and metal corrosion may occur.

In addition, the oil composition of the present invention may include a silicon-based defoaming agent. The silicon-based defoaming agent may be present in an amount of less than about 2% by weight, or particularly of about 0.0005 to 2% by weight, in the oil composition of the present invention. When the content of the defoaming agent is greater than about 2% by weight, there may occur problems such as reduced defoaming property or deposition of the defoaming agent from the lubricant oil.

The oil composition of the present invention can be prepared by mixing the respective ingredients described above. There is no limitation as to a mixing order of these ingredients.

Preferably, the base oil may be first prepared and additives may be sequentially added in order of increasing activity, for example, from lowest activity to highest activity. As such, the method may comprise, after providing the base oil, adding sequentially the detergent dispersant, the abrasion-resistant agent, the friction reducer, and the viscosity controller to the base oil in this order. For example, after providing the base oil, an amount of about 1 to 10% by weight of calcium salicylate; an amount of about 1 to 5% by weight of zinc dialkyldithiophosphate and an amount of about 0.1 to 2% by weight of molybdenum dithiocarbamate; an amount of about 1 to 5% by weight of a $C_{10-40}$ alkyl hydroxy benzoate metal salt and glycerol monooleate; and an amount of about 5 to 15% by weight of a hydrogenated styrene-diene copolymer may be sequentially added in this order.

Preferably, under the same activity condition, the additives may be mixed in order of increasing added amount from largest amount to smallest amount. After mixing, the resulting mixture may be stirred using a stirrer at temperatures of about 70° C. or greater. The rate of the stirrer may be controlled according to the size of the stirrer and design size. For example, when a stirrer having a size less than the predetermined size (for example, 20 cm×20 cm×50 cm) is used, stirring may be performed at a stirring rate of about 300 to 500 rpm. When a stirrer having a size greater than the predetermined size (for example, 50 cm×50 cm×100 cm) is used, stirring may be preferably performed at a stirring rate of about 100 to 400 rpm.

The following examples illustrate the invention and are not intended to limit the same.

Example

Prepared respective ingredients were injected into a reactor and mixed at a temperature of 70° C. and a stirring rate of 400 rpm to prepare a diesel engine oil composition.

[Respective Ingredients of Diesel Engine Oil Composition]

(1) Base oil: a kinematic viscosity at a temperature of 100° C. of 3 to 10 cSt and a viscosity index of 120 or greater (2) Detergent dispersant: calcium salicylate (available from Infineum Corp., United Kingdom)

(3) Friction reducer:

① $C_{10-40}$ alkyl hydroxy benzoate metal salt (AHB, available from Infineum Corp., United Kingdom)

② Glycerol monooleate (GMO, available from Lubrizol Corp., United Kingdom)

(4) Viscosity controller: hydrogenated styrene-diene copolymer (HSD, available from Infineum Corp., United Kingdom)

(5) Abrasion-resistant agent:

① Zinc dialkyldithiophosphate (Zn-DTP, available from Infineum Corp., United Kingdom)

② Molybdenum dithiocarbamate (MoDTP, S525 available from Adeca Co., Ltd., United Kingdom)

(6) Antioxidant: 3-hydroxydiphenylamine

[Method for Evaluating Performance of Engine Oils]

(A) Kinematic Viscosity at a Temperature of 100° C.:

Kinematic viscosity at 100° C. was measured in accordance with ASTM D 445. That is, a sample was sucked up into a glass tube in a bath kept at a temperature of 100° C.

and a time during which the sample fell was measured. The time was converted into kinematic viscosity.

(B) High-Temperature High-Shear Viscosity at a Temperature of 80° C.:

The high-temperature high-shear viscosity at a temperature of 80° C. was measured in accordance with ASTM D 4683. That is, torque was measured at a temperature of 80° C. and at a shear rate of $10^6$ and was then converted into viscosity.

(C) SRV Friction Coefficient:

The SRV friction coefficient was measured in accordance with ASTM D 6425. That is, friction coefficients were measured under conditions of 200 N, 50 Hz and 100° C. for 2 hours and an average was calculated.

Figure 2:
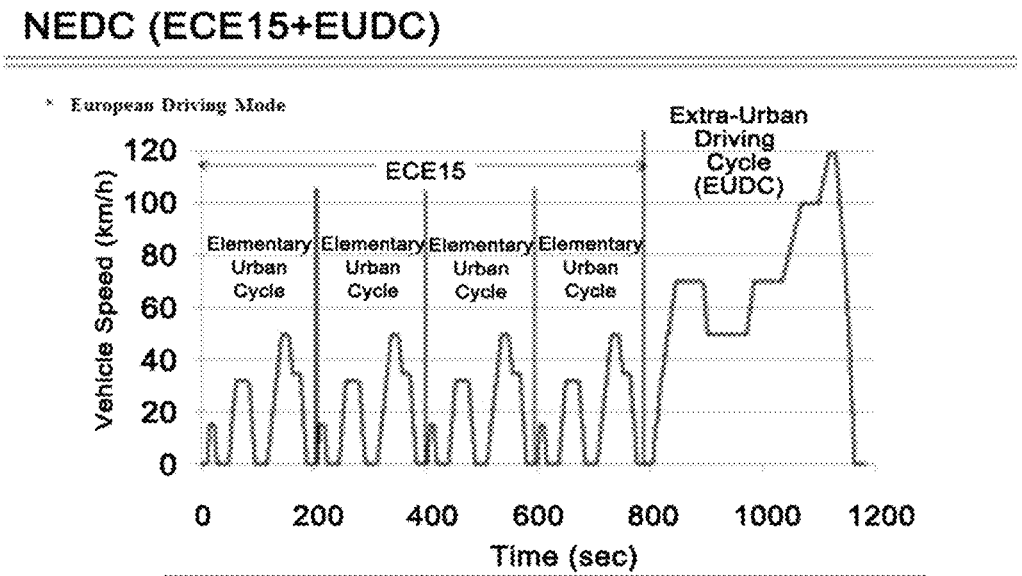
FIG. 2 shows fuel economy improvement measured by NEDC (certification mode).

(D) Fuel Economy Improvement:

Fuel economy improvement was measured by NEDC (certification mode) as shown in FIG. 2. That is, the target engine was evaluated by simulating the following driving conditions in accordance with European fuel economy (New European Driving Cycle) international certification mode.

(E) An increase in kinematic viscosity at a temperature of 100° C. (cSt): An increase in kinematic viscosity at a temperature of 100° C. (cSt) was measured in accordance with Bohlin soot dispersancy test. That is, a soot 10%-added engine oil was heated at a temperature of 100° C. for 18 hours and kinematic viscosity thereof was then measured.

Table 1 shows a comparison in performance of engine oils according to variation of content of viscosity controller (HSD) in the diesel engine oil composition. In Examples 1 to 5, in which compositions included an amount of 5 to 15% by weight of viscosity controller (HSD), HSD might surround soot to allow the soot to be uniformly dispersed without adhering to the metal surface and thereby exhibit the effect of inhibiting an increase in viscosity. In particular, the HSD had potent effects of reducing high-temperature high-shear viscosity and a kinematic viscosity increase at a temperature of 100° C. The diesel engine oil compositions of Examples 1 to 5 were highly effective in improving durability and fuel economy by inhibition of a viscosity increase.

On the other hand, in Comparative Example 1, in which the composition included the viscosity controller (HSD) in a small amount of 3% by weight, the effect of inhibiting a viscosity increase was insufficient due to low soot dispersion, and in Comparative Example 2, in which the composition included the viscosity controller (HSD) in an excessive amount of 18% by weight, the effect of inhibiting a viscosity increase was insufficient due to strong interaction between non-polar moieties of HSD, and low soot dispersion.

In addition, in Comparative Examples 3 and 4, in which the compositions included a polymethylacrylate and olefin

TABLE 1

| Items (wt %) | | | Examples | | | | | Comparative Examples | | | |
|---|---|---|---|---|---|---|---|---|---|---|---|
| | | | 1 | 2 | 3 | 4 | 5 | 1 | 2 | 3 | 4 |
| Composition | Base oil | | 85 | 83 | 80 | 77 | 75 | 87 | 72 | 85 | 85 |
| | Detergent dispersant | Calcium salicylate | 4 | 4 | 4 | 4 | 4 | 4 | 4 | 4 | 4 |
| | Friction Reducer | Alkyl hydroxy benzoate metal salt | 1.5 | 1.5 | 1.5 | 1.5 | 1.5 | 1.5 | 1.5 | 1.5 | 1.5 |
| | | Viscosity Controller | 0.5 | 0.5 | 0.5 | 0.5 | 0.5 | 0.5 | 0.5 | 0.5 | 0.5 |
| | Viscosity Controller | Hydrogenated styrene-diene | 5 | 7 | 10 | 13 | 15 | 3 | 18 | — | — |
| | | Polymethyl-acrylate | — | — | — | — | — | — | — | 5 | — |
| | | Olefin copolymer | — | — | — | — | — | — | — | — | 5 |
| | Abrasion-resistant agent | Zinc dialkyldithio-phosphate | 2 | 2 | 2 | 2 | 2 | 2 | 2 | 2 | 2 |
| | | Molybdenum dithio-carbamate | 0.4 | 0.4 | 0.4 | 0.4 | 0.4 | 0.4 | 0.4 | 0.4 | 0.4 |
| | Antioxidant | 3-hydroxydi-phenylamine | 1.6 | 1.6 | 1.6 | 1.6 | 1.6 | 1.6 | 1.6 | 1.6 | 1.6 |
| Performance evaluation | 100° C. kinematic viscosity (cSt) | | 8.2 | 8.2 | 8.2 | 8.2 | 8.2 | 8.2 | 8.2 | 8.2 | 8.2 |
| | High-temperature high-shear viscosity at 80° C. (cP) | | 9.4 | 9.3 | 9.2 | 9.3 | 9.4 | 9.5 | 9.5 | 9.5 | 9.5 |
| | SRV friction coefficient (100° C.) | | 0.057 | 0.050 | 0.046 | 0.051 | 0.058 | 0.057 | 0.056 | 0.054 | 0.056 |
| | Fuel economy improvement (Target fuel economy, %) | | 0.3 | 0.4 | 0.5 | 0.4 | 0.3 | 0.3 | 0.3 | 0.3 | 0.3 |
| | Increase in kinematic viscosity at 100° C. (Soot 10% addition, %) | | 13 | 13 | 10 | 12 | 14 | 15 | 15 | 15 | 17 |

copolymer as the viscosity controller, the kinematic viscosity increase at a temperature of 100° C. was maintained to a high level.

TABLE 2

| Items (wt %) | | | Comparative Examples 5 | 6 | 7 | 8 | 9 |
|---|---|---|---|---|---|---|---|
| Composition | | Base oil | 86 | 86 | 86 | 86 | 86 |
| | Detergent dispersant | Calcium salicylate | 4 | 4 | 4 | 4 | 4 |
| | Friction Reducer | Alkyl hydroxy benzoate metal salt | 0.875 | 0.858 | 0.5 | 0.142 | 0.125 |
| | | Glycerol monooleate | 0.125 | 0.142 | 0.5 | 0.858 | 0.875 |
| | Viscosity Controller | Hydrogenated styrene-diene | — | — | — | — | — |
| | | Polymethylacrylate | 5 | 5 | 5 | 5 | 5 |
| | Abrasion-resistant agent | Zinc dialkyldithiophosphate | 2 | 2 | 2 | 2 | 2 |
| | | Molybdenum dithiocarbamate | 0.4 | 0.4 | 0.4 | 0.4 | 0.4 |
| | Antioxidant | 3-Hydroxydiphenyl-amine | 1.6 | 1.6 | 1.6 | 1.6 | 1.6 |
| Performance evaluation | SRV friction coefficient (100° C.) | | 0.060 | 0.057 | 0.057 | 0.058 | 0.060 |
| | Fuel economy improvement (Target fuel economy, %) | | 0 | 0.2 | 0.2 | 0.1 | 0 |
| | Increase in kinematic viscosity at 100° C. (Soot 10% addition, %) | | 15 | 15 | 15 | 15 | 15 |

Table 2 shows a comparison in performance of engine oils when a mix ratio of AHB and GMO was changed to 7:1, 6:1, 1:1, 1:6, and 1:7 in a case where 1% by weight of a mixture of $C_{10-40}$ alkyl hydroxy benzoate metal salt (AHB) and glycerol monooleate (GMO) as the friction reducer was present in the diesel engine oil composition including polymethylacrylate as the viscosity controller, instead of HSD. It could be seen that the compositions according to Comparative Examples 5 to 9 included polymethylacrylate, as the viscosity controller, instead of HSD, thereby maintaining a great increase in kinematic viscosity at a temperature of 100° C., as compared to compositions of Examples 1 to 5. In addition, it could be seen that SRV friction coefficient and fuel economy improvement were changed according to a mix ratio of AHB and GMO as the friction reducer and that the compositions of Comparative Examples 6 to 8 including AHB and GMO in a weight ratio of 1:6 to 6:1 exhibited superior SRV friction coefficient and fuel economy improvement.

TABLE 3

| Items (wt %) | | | Comparative Examples 10 | 11 | 12 | 13 | 14 |
|---|---|---|---|---|---|---|---|
| Composition | | Base oil | 85 | 85 | 85 | 85 | 85 |
| | Detergent dispersant | Calcium salicylate | 4 | 4 | 4 | 4 | 4 |
| | Friction reducer | Alkyl hydroxy benzoate metal salt | 1.75 | 1.715 | 1 | 0.285 | 0.25 |
| | | Glycerol monooleate | 0.25 | 0.285 | 1 | 0.715 | 1.75 |
| | Viscosity Controller | Hydrogenated styrene-diene | — | — | — | — | — |
| | | Polymethylacrylate | 5 | 5 | 5 | 5 | 5 |
| | Abrasion-resistant agent | Zinc dialkyldithiophosphate | 2 | 2 | 2 | 2 | 2 |
| | | Molybdenum dithiocarbamate | 0.4 | 0.4 | 0.4 | 0.4 | 0.4 |
| | Antioxidant | 3-Hydroxydiphenyl-amine | 1.6 | 1.6 | 1.6 | 1.6 | 1.6 |
| Performance evaluation | SRV friction coefficient (100° C.) | | 0.060 | 0.054 | 0.056 | 0.059 | 0.061 |
| | Fuel economy improvement (Target fuel economy, %) | | 0 | 0.4 | 0.3 | 0.2 | 0 |
| | Increase in kinematic viscosity at 100° C. (Soot 10% addition, %) | | 15 | 15 | 15 | 15 | 15 |

Table 3 shows a comparison in performance of engine oils when a mix ratio of AHB and GMO was changed to 7:1, 6:1, 1:1, 1:6, and 1:7 in a case where 2% by weight of a mixture of $C_{10-40}$ alkyl hydroxy benzoate metal salt (AHB) and glycerol monooleate (GMO) as the friction reducer was present in the diesel engine oil composition including polymethylacrylate as the viscosity controller, instead of HSD. It could be seen that the compositions according to Comparative Examples 10 to 14 included polymethylacrylate, as the viscosity controller, instead of HSD, thereby maintaining a great increase in kinematic viscosity at a temperature of 100° C., as compared to compositions of Examples 1 to 5. In addition, it could be seen that SRV friction coefficient and fuel economy improvement were changed according to a mix ratio of AHB and GMO as the friction reducer and that the compositions of Comparative Examples 11 to 13 including AHB and GMO in a weight ratio of 1:6 to 6:1 exhibited superior SRV friction coefficient and fuel economy improvement.

TABLE 4

| Items (wt %) | | | Comparative Examples 15 | 16 | 17 | 18 | 19 |
|---|---|---|---|---|---|---|---|
| Composition | | Base oil | 84 | 84 | 84 | 84 | 84 |
| | Detergent dispersant | Calcium salicylate | 4 | 4 | 4 | 4 | 4 |
| | Friction reducer | Alkyl hydroxy benzoate metal salt | 2.625 | 2.572 | 1.5 | 0.428 | 0.375 |
| | | Glycerol monooleate | 0.375 | 0.428 | 1.5 | 2.572 | 2.625 |
| | Viscosity Controller | Hydrogenated styrene-diene | — | — | — | — | — |
| | | Polymethylacrylate | 5 | 5 | 5 | 5 | 5 |
| | Abrasion-resistant agent | Zinc dialkyldithiophosphate | 2 | 2 | 2 | 2 | 2 |
| | | Molybdenum dithiocarbamate | 0.4 | 0.4 | 0.4 | 0.4 | 0.4 |
| | Antioxidant | 3-Hydroxydiphenyl-amine | 1.6 | 1.6 | 1.6 | 1.6 | 1.6 |
| Performance evaluation | SRV friction coefficient (100° C.) | | 0.060 | 0.055 | 0.0056 | 0.057 | 0.060 |
| | Fuel economy improvement (Target fuel economy, %) | | 0 | 0.3 | 0.3 | 0.2 | 0 |
| | Increase in kinematic viscosity at 100° C. (Soot 10% addition, %) | | 15 | 15 | 15 | 15 | 15 |

Table 4 shows a comparison in performance of engine oils when a mix ratio of AHB and GMO was changed to 7:1, 6:1, 1:1, 1:6, and 1:7 in a case where 3% by weight of a mixture of $C_{10-40}$ alkyl hydroxy benzoate metal salt (AHB) and glycerol monooleate (GMO) as the friction reducer was present in the diesel engine oil composition including polymethylacrylate as the viscosity controller, instead of HSD. It could be seen that the compositions according to Comparative Examples 15 to 19 included polymethylacrylate, as the viscosity controller, instead of HSD, thereby maintaining a great increase in kinematic viscosity at 100° C., as compared to compositions of Examples 1 to 5. In addition, it could be seen that SRV friction coefficient and fuel economy improvement were changed according to a mix ratio of AHB and GMO as the friction reducer and that the compositions of Comparative Examples 16 to 18 including AHB and GMO in a weight ratio of 1:6 to 6:1 exhibited superior SRV friction coefficient and fuel economy improvement.

TABLE 5

| Items (wt %) | | | Comparative Examples 20 | 21 | 22 | 23 | 24 |
|---|---|---|---|---|---|---|---|
| Composition | | Base oil | 82 | 82 | 82 | 82 | 82 |
| | Detergent dispersant | Calcium salicylate | 4 | 4 | 4 | 4 | 4 |
| | Friction reducer | Alkyl hydroxy benzoate metal salt | 4.375 | 4.286 | 2.5 | 0.714 | 0.625 |
| | | Glycerol monooleate | 0.625 | 0.714 | 2.5 | 4.286 | 4.375 |
| | Viscosity Controller | Hydrogenated styrene-diene | — | — | — | — | — |
| | | Polymethylacrylate | 5 | 5 | 5 | 5 | 5 |
| | Abrasion-resistant agent | Zinc dialkyldithiophosphate | 2 | 2 | 2 | 2 | 2 |
| | | Molybdenum dithiocarbamate | 0.4 | 0.4 | 0.4 | 0.4 | 0.4 |
| | Antioxidant | 3-Hydroxydiphenyl-amine | 1.6 | 1.6 | 1.6 | 1.6 | 1.6 |
| Performance evaluation | SRV friction coefficient (100° C.) | | 0.061 | 0.057 | 0.056 | 0.059 | 0.061 |
| | Fuel economy improvement (Target fuel economy, %) | | 0 | 0.2 | 0.2 | 0.1 | 0 |
| | Increase in kinematic viscosity at 100° C. (Soot 10% addition, %) | | 15 | 15 | 15 | 15 | 15 |

Table 5 shows a comparison in performance of engine oils when a mix ratio of AHB and GMO was changed to 7:1, 6:1, 1:1, 1:6, and 1:7 in a case where 5% by weight of a mixture of $C_{10-40}$ alkyl hydroxy benzoate metal salt (AHB) and glycerol monooleate (GMO) as the friction reducer was present in the diesel engine oil composition including polymethylacrylate as the viscosity controller, instead of HSD. It could be seen that the compositions according to Comparative Examples 20 to 24 included polymethylacrylate, as the viscosity controller, instead of HSD, thereby maintaining a great increase in kinematic viscosity at a temperature of 100° C., as compared to compositions of Examples 1 to 5. In addition, it could be seen that SRV friction coefficient and fuel economy improvement were changed according to a mix ratio of AHB and GMO as the friction reducer and that the compositions of Comparative Examples 21 to 23 including AHB and GMO in a weight ratio of 1:6 to 6:1 exhibited superior SRV friction coefficient and fuel economy improvement.

fuel economy improvement were significantly low because AHB and GMO as the friction reducer were maintained at a weight ratio of 1:6 to 6:1, but the total weight thereof was an excessive amount exceeding 0.5% by weight.

As apparent from the foregoing, the oil composition of the present invention may have substantially reduced kinematic viscosity, substantially reduced viscosity at high-temperature high-shear condition and substantially reduced friction coefficient, thereby being highly effective in improving fuel economy.

In addition, the oil composition of the present invention may exhibit an increase in viscosity of engine oils by efficient dispersion of soot generated during vehicle driving, thereby being highly effective in improving durability of engines.

Accordingly, the oil composition according to the present invention may have both high fuel economy and durability, thereby being useful as a diesel engine oil.

TABLE 6

| Items (wt %) | | | Comparative Examples 25 | 26 | 27 | 28 | 29 | 30 |
|---|---|---|---|---|---|---|---|---|
| Composition | | Base oil | 86.5 | 86.5 | 86.5 | 81.5 | 81.5 | 81.5 |
| | Detergent dispersant | Calcium salicylate | 4 | 4 | 4 | 4 | 4 | 4 |
| | Friction reducer | Alkyl hydroxy benzoate metal salt | 0.429 | 0.25 | 0.071 | 4.715 | 2.75 | 0.785 |
| | | Glycerol monooleate | 0.071 | 0.25 | 0.429 | 0.785 | 2.75 | 4.715 |
| | Viscosity Controller | Hydrogenated styrene-diene | — | — | — | — | — | — |
| | | Polymethylacrylate | 5 | 5 | 5 | 5 | 5 | 5 |
| | Abrasion-resistant agent | Zinc dialkyldithiophosphate | 2 | 2 | 2 | 2 | 2 | 2 |
| | | Molybdenum dithiocarbamate | 0.4 | 0.4 | 0.4 | 0.4 | 0.4 | 0.4 |
| | Antioxidant | 3-Hydroxydiphenyl-amine | 1.6 | 1.6 | 1.6 | 1.6 | 1.6 | 1.6 |
| Performance evaluation | SRV friction coefficient (100° C.) | | 0.060 | 0.062 | 0.061 | 0.061 | 0.062 | 0.061 |
| | Fuel economy improvement (Target fuel economy, %) | | 0 | 0 | 0 | 0 | 0 | 0 |
| | Increase in kinematic viscosity at 100° C. (Soot 10% addition, %) | | 15 | 15 | 15 | 15 | 15 | 15 |

Table 6 shows a comparison in performance of engine oils according to total weight of the mixture of $C_{10-40}$ alkyl hydroxy benzoate metal salt (AHB) and glycerol monooleate (GMO) as the friction reducer was present in the diesel engine oil composition including polymethylacrylate as the viscosity controller, instead of HSD. It could be seen that the compositions according to Comparative Examples 25 to 27 included polymethylacrylate, as the viscosity controller, instead of HSD, thereby maintaining a great increase in kinematic viscosity at a temperature of 100° C., as compared to compositions of Examples 1 to 5. In addition, it could be seen that SRV friction coefficient and fuel economy improvement were significantly low because AHB and GMO as the friction reducer were maintained at a weight ratio of 1:6 to 6:1, but the total weight thereof was a small amount of 0.5% by weight.

It could be seen that the compositions according to Comparative Examples 28 to 30 included polymethylacrylate, as the viscosity controller, instead of HSD, thereby maintaining a great increase in kinematic viscosity at 100° C., as compared to compositions of Examples 1 to 5. In addition, it could be seen that SRV friction coefficient and The invention has been described in detail with reference to various exemplary embodiments thereof. However, it will be appreciated by those skilled in the art that changes may be made in these embodiments without departing from the principles and spirit of the invention, the scope of which is defined in the appended claims and their equivalents.

What is claimed is:

1. An oil composition comprising:

an amount of about 70 to 90% by weight of a base oil having a kinematic viscosity at 100° C. of about 3 to 10 cSt;

an amount of about 1 to 10% by weight of calcium salicylate;

an amount of about 1 to 5% by weight of a $C_{10-40}$ alkyl hydroxy benzoate metal salt and glycerol monooleate; and an amount of about 5 to 15% by weight of a hydrogenated styrene-diene copolymer, all the % by weights based on the total weight of the oil composition, wherein the $C_{10-40}$ alkyl hydroxyl benzoate metal salt and the glycerol monooleate are present in a weight ratio of 1:6 to 6:1.

2. The oil composition of claim 1, wherein the $C_{10-40}$ alkyl hydroxy benzoate metal salt and the glycerol monooleate are present in a weight ratio of about 1:3 to 3:1.

3. The oil composition of claim 1, further comprising:

an amount of about 1 to 5% by weight of zinc dialkyldithiophosphate and an amount of about 0.1 to 2% by weight of molybdenum dithiocarbamate, based on the total weight of the oil composition.

4. The oil composition of claim 1, consisting essentially of:

an amount of about 70 to 90% by weight of a base oil having a kinematic viscosity at a temperature of 100° C. of about 3 to 10 cSt, an amount of about 1 to 10% by weight of calcium salicylate, an amount of about 1 to 5% by weight of a $C_{10-40}$ alkyl hydroxy benzoate metal salt and glycerol monooleate, and an amount of about 5 to 15% by weight of a hydrogenated styrene-diene copolymer, all the % by weights are based on the total weight of the oil composition.

5. The oil composition of claim 1, consisting essentially of:

an amount of about 70 to 90% by weight of a base oil having a kinematic viscosity at a temperature of 100° C. of about 3 to 10 cSt, an amount of about 1 to 10% by weight of calcium salicylate, an amount of about 1 to 5% by weight of a $C_{10-40}$ alkyl hydroxy benzoate metal salt and glycerol monooleate, an amount of about 5 to 15% by weight of a hydrogenated styrene-diene copolymer, an amount of about 1 to 5% by weight of zinc dialkyldithiophosphate, and an amount of about 0.1 to 2% by weight of molybdenum dithiocarbamate, all the % by weights are based on the total weight of the oil composition.

6. A method of preparing an oil composition of claim 1, comprising:

providing the base oil;

adding the remaining components to form a mixture; and stirring the mixture using a stirrer at temperatures of about 70° C. or greater.

7. The method of claim 6, wherein the remaining components are sequentially added in order of increasing activity from lowest to highest.

8. The method of claim 7, wherein after providing the base oil, an amount of about 1 to 10% by weight of calcium salicylate; an amount of about 1 to 5% by weight of zinc dialkyldithiophosphate and an amount of about 0.1 to 2% by weight of molybdenum dithiocarbamate; an amount of about 1 to 5% by weight of a $C_{10-40}$ alkyl hydroxy benzoate metal salt and glycerol monooleate; and an amount of about 5 to 15% by weight of a hydrogenated styrene-diene copolymer are sequentially added in this order to the base oil.

9. The method of claim 6, wherein the remaining components are sequentially added in order of increasing added amount from largest amount to smallest amount.

10. A vehicle that comprises an oil composition of claim 1.

* * * * *